US005410821A

United States Patent [19]

Hilgendorf

[11] Patent Number: 5,410,821

[45] Date of Patent: May 2, 1995

[54] SHOE WITH INTERCHANGABLE SOLES

[76] Inventor: Eric Hilgendorf, 3500 Tanglebrush #188, The Woodlands, Tex. 77380

[21] Appl. No.: 822,666

[22] Filed: Jan. 21, 1992

[51] Int. Cl.[6] ..... A43B 13/36

[52] U.S. Cl. ..... 36/100; 36/132; 36/15; 36/77 R; 36/73

[58] Field of Search ..... 36/15, 72 R, 73, 77 R, 36/99, 100, 101, 114, 132

[56] References Cited

U.S. PATENT DOCUMENTS

| | | | |
|---|---|---|---|
| 1,360,995 | 12/1920 | Anderson | 36/73 |
| 4,267,650 | 5/1981 | Bauer | 36/15 |
| 4,702,020 | 10/1987 | Kroeger | 36/132 |
| 4,774,776 | 10/1988 | Gulli | 36/132 |

FOREIGN PATENT DOCUMENTS

| | | | |
|---|---|---|---|
| 25849 | of 1907 | United Kingdom | 36/15 |
| 2178940 | 2/1987 | United Kingdom | 36/101 |
| 8604489 | 8/1986 | WIPO | 36/15 |

*Primary Examiner*—Paul T. Sewell
*Assistant Examiner*—M. D. Patterson
*Attorney, Agent, or Firm*—Harrison & Egbert

[57] ABSTRACT

The present invention is a sport shoe having a shoe upper with an interior for receiving a human foot and a bottom surface formed thereon, a removable foresole attached to a forward portion of the bottom surface of the shoe upper and having a toe receptacle for fitting against a toe area of the shoe upper, and a strap fastened to one side of the removable foresole and extending over the toe area of the shoe upper so as to removably fasten the foresole to the bottom side of the shoe upper. The shoe upper has a longitudinal track formed in the bottom surface. A longitudinal strut is connected to the removable foresole and extends rearwardly therefrom. The longitudinal strut is received by the longitudinal track in the bottom surface of the shoe upper. A plurality of receptacles are formed in the bottom surface of the shoe so as to receive tab elements branching outwardly from the longitudinal strut. A suitable locking member is formed on an exterior surface of the shoe upper opposite the toe area so as to lock the foresole to the shoe upper in tensioned relationship.

12 Claims, 3 Drawing Sheets

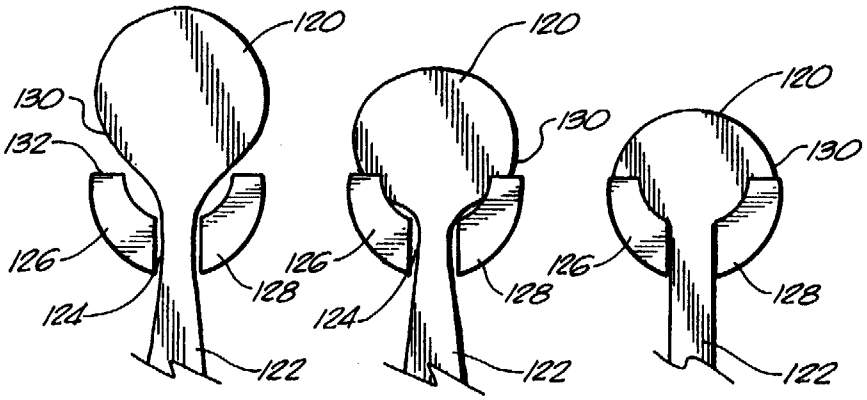
FIG. 4A
FIG. 4B
FIG. 4C
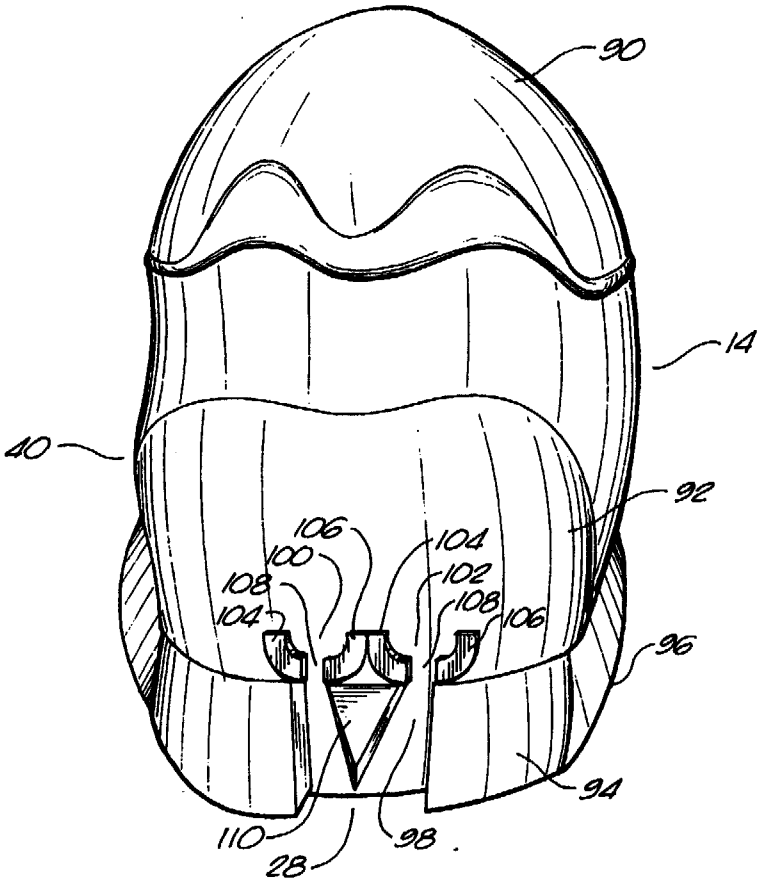
FIG. 3

SHOE WITH INTERCHANGABLE SOLES

TECHNICAL FIELD

The present invention relates to shoes, in general. More particularly, the present invention relates to shoes having removable portions, such as easily removable foresoles.

BACKGROUND ART

There are three basic methods that have been used in the past for attaching soles to the uppers of shoes. The bottoming may be done by sewing, cementing, nailing, or a combination of these three joining techniques. Nailing may be done with nails, screws, staples, or pegs. The sewing may be with or without the use of welt, insole, middle sole and filler sections; the same applies to cementing soles to uppers. Sole sections vary in plycount; a three-ply sole has a middle sole sandwiched between an outer sole and an inner sole; the two-ply sole consists of outer and inner soles; the single sole has only one ply.

In sports, the type of sole on the shoe has a major impact on the ability of the user to properly move about the surface. In tennis, in particular, a wide variety of tennis court surfaces exist. Many times, the sole of a shoe that is appropriate on one type of tennis court surface would be wholly inappropriate on another tennis court surface. Often, among experienced players, the soles of shoes can become worn so that they are no longer of an optimal condition. Additionally, and furthermore, it is important to be able to vary the texture of the sole surface to accommodate the court requirements, the play requirements, and the comfort of the wearer.

Unfortunately, in order to have a wide array of various sole textures, it is presently necessary that the wearer own a large number of pairs of shoes. This can be extremely expensive and can occupy a great deal of space. During a tennis match, there is often little or no time available in which to change shoes. For many wearers, the lacing of the tennis shoes is extremely important to athletic performance. As such, a great deal of time must be expended properly lacing the shoes so as to accommodate the needs of the user. In addition, tennis players must quickly change shoes during a match whenever the soles of the shoes become excessively worn. It is desirable to be able to change soles during a tennis match.

In the past, various patents have addressed the need for removable soles. U.S. Pat. No. 818,173, issued on Apr. 17, 1906, to J. M. Hoffman describes an anti-slipping removable sole for shoes in which a clip wraps around the exterior edges of a regular shoe. A clamp is provided so as to cause the rearward edges of the removable sole to fasten to the outer extending leather edge of the shoe sole. U.S. Pat. No. 1,918,639, issued on Jul. 18, 1933, to I. S. Greentree provides an anti-slip attachment for shoes in which a midsole is fastened by brackets to the outside edge of a shoe sole. An extending ring fastens to the rearward portion of the removable sole. The removable sole has a plurality of holes built therein for providing an anti-slip surface. U.S. Pat. No. 1,857,751, issued on May 10, 1932, to R. Wollmer has a plurality of brackets extending around the periphery of the sole for engaging the extending leather portion of a shoe. U.S. Pat. No. 4,214,384, issued on Jul. 29, 1980, to R. Gonzalez discloses a shoe having a first coupling element secured on a heel portion and a second coupling element, defining a heel thereon, slidably mounted in interlocking relationship with the first coupling element. A resilient locking tab on the second coupling element engages a locking groove formed on the first coupling element. The heel is maintained in position by a removable wedge. Additionally, U.S. Pat. No. 4,542,599, issued on Sep. 24, 1985, to G. Annovi discloses a ski boot having a foot portion and sole constructed for comfort and easy walking. A separately formed normalized shoe attachment for the ski boot interlocks securely with the boot and renders the boot compatible with any ski binding.

It is an object of the present invention to provide a shoe having an interchangable sole.

It is another object of the present invention to provide a sport shoe having interchangable soles which are adapted to be used on a wide variety of surfaces and a wide variety of materials (of varying degrees of abrasiveness).

It is a further object of the present invention to provide a shoe having a removable sole which is properly tensioned on the bottom of the shoe.

It is still another object of the present invention to provide a shoe having a removable sole which is securely fastened to the shoe upper.

It is still another object of the present invention to provide a shoe with an interchangable sole which is relatively inexpensive, easy to use, and simple to manufacture.

These and other objects and advantages of the present invention will become apparent from a reading of the attached specification and appended claims.

SUMMARY OF THE INVENTION

The present invention is a shoe having a shoe upper with an interior for receiving a human foot, a removable sole affixed to a forward portion of the bottom surface of the shoe upper, and a locking means formed on the removable sole for fastening the sole to the bottom surface of the shoe upper. The shoe upper has a toe area formed therein. The removable sole includes a toe receptacle for slidably fitting against the toe area of the shoe upper.

A slotted member is formed on an exterior surface of the shoe upper. This slotted member is formed on an end of the shoe upper opposite the toe area. The slotted member serves to receive the locking means. The slotted member specifically comprises a first quartercircle having an indentation formed adjacent to the shoe upper and a second quartercircle facing the first quartercircle. The second quartercircle has another indentation formed adjacent to the shoe upper. The first and second quartercircles also have a slot extending therebetween. A second slotted member is formed adjacent to the first slotted member on an end of the shoe upper opposite the toe area. A longitudinal strut extends from the removable sole on an underside of the shoe upper and has a circular tab which engages one of the first and second quartercircles. The strut extends through the slot between the quartercircles.

The removable sole has an outsole formed on a bottom side of the removable sole. This outsole has a desired surface-engaging texture. A strap is fastened to one side of the removable sole and extends over the toe area of the shoe upper. The strap is removably connected to another side of the sole. The other side of the sole has a loop fastened thereto. The loop receives the strap therethrough so as to securely fasten the sole to the shoe upper. Specifically, the strap has one surface of hook-and-loop material and another surface of hook-and-loop material. The surfaces are detachably fastened together.

The shoe upper has a longitudinal track formed in the bottom surface. The locking means includes a longitudinal strut that is connected to the removable sole and extends rearwardly therefrom. This longitudinal strut is received by the longitudinal track in the bottom surface of the shoe upper. The shoe upper also has a plurality of receptacles formed in the bottom surface and which branch outwardly from the longitudinal track. The longitudinal strut has a plurality of tab elements which branch outwardly from the longitudinal strut. The receptacles serve to receive the tab elements in secure engagement. In particular, the shoe upper has a first pair of receptacles formed on a bottom surface generally adjacent to the removable sole. The shoe upper has a second pair of receptacles formed on an opposite side of the shoe upper rearward of the first pair of receptacles. A third pair of receptacles are formed on an end of the shoe upper opposite the toe area. These receptacles receive the tab elements of the longitudinal strut so as to cause the longitudinal strut to be in tensioned relationship with the sole.

BRIEF DESCRIPTION OF THE DRAWINGS

FIG. 3 is a rearward view of the shoe of the present invention.

FIGS. 4A–C show, sequentially, the locking of a tab element into the slots on the rear of the shoe of the present invention.

DETAILED DESCRIPTION OF THE INVENTION

Figure 1:
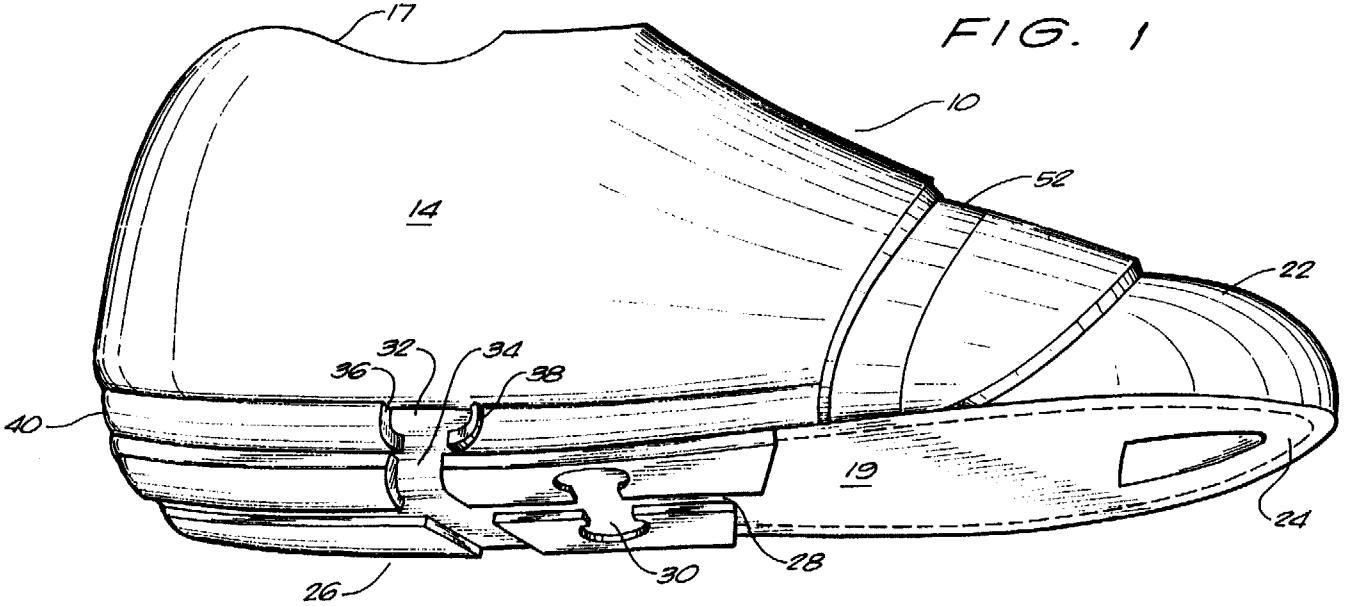
FIG. 1 is a bottom side perspective view of the shoe upper of the present invention.
Figure 2:
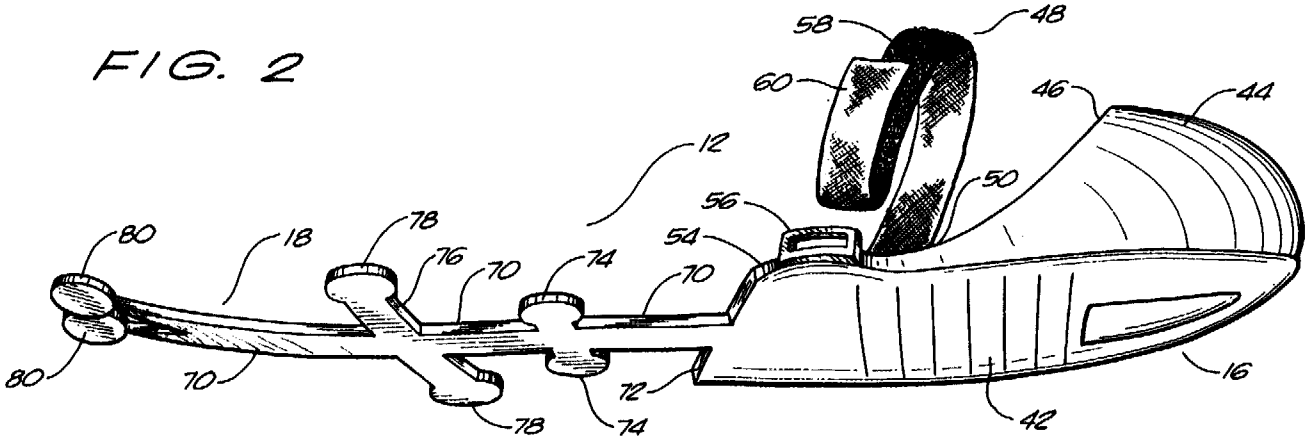
FIG. 2 is a bottom side perspective view of the removable sole in accordance with the preferred embodiment of the present invention.
Figure 5:
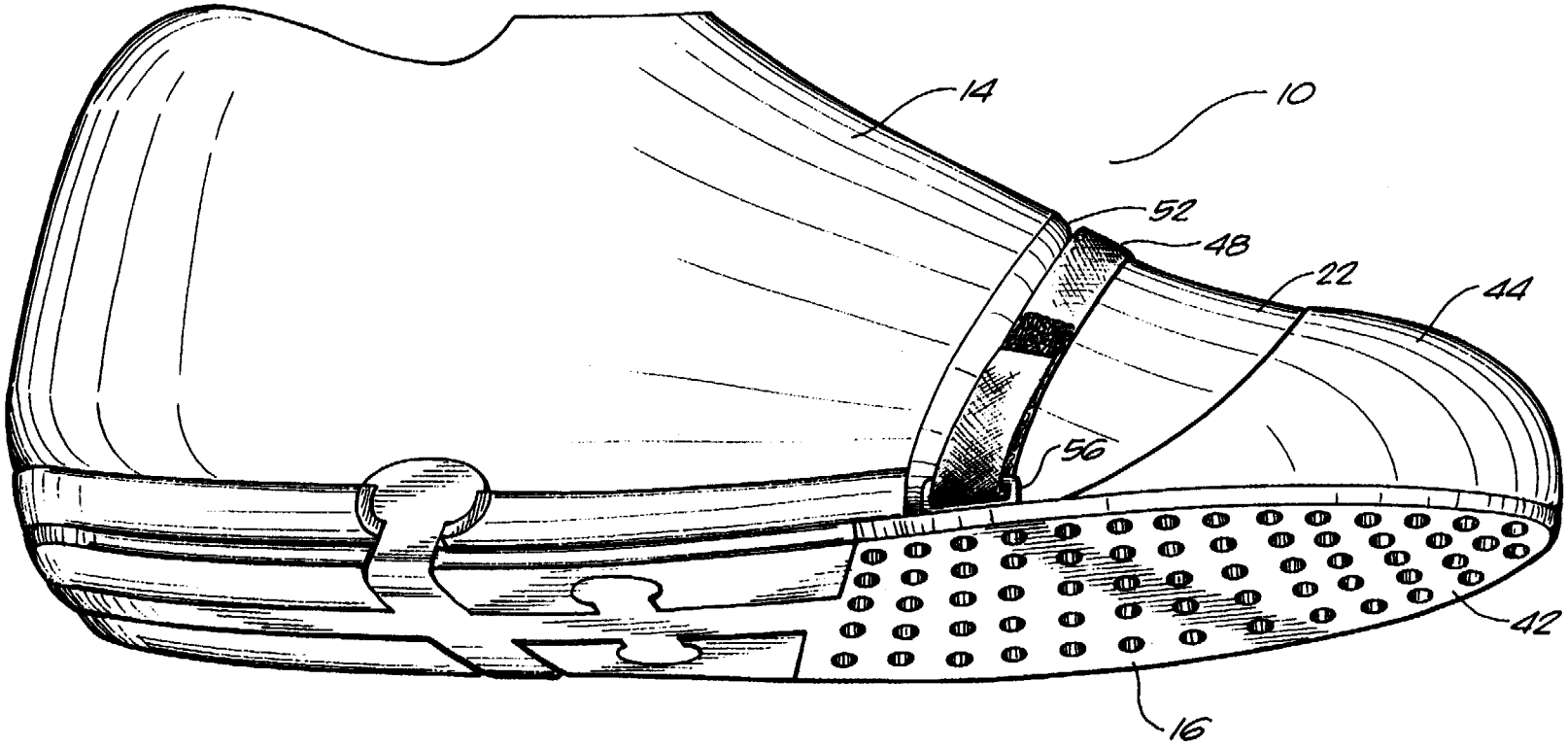
FIG. 5 is a bottom side perspective view of the assembled shoe of the present invention.

Referring to FIGS. 1 and 2, there is shown at 10, the shoe, and, at 12, the sole, in accordance with the preferred embodiment of the present invention. Specifically, the shoe 10 comprises a shoe upper 14, a removable sole 16, and a suitable locking member 18. FIG. 5 shows the shoe in its assembled condition.

The shoe upper 14 has an interior 17 which is suitable for receiving a human foot. Interior 17 is of a style of a conventional shoe. The appropriate sizing and shaping of the interior 17 will be in accordance with individual preferences or requirements. Importantly, the shoe upper 14 has a bottom surface 19 formed thereon. Bottom surface 19 provides a surface upon which a human foot can rest when it is received within the interior 17 of shoe upper 14. It can be seen that the shoe upper 14 also includes a toe area 22 which is formed thereon. The shoe upper 14 has a rather conventional appearance (but for the bottom surface 19).

The bottom surface 19 is attached to toe area 22 by threading, adhesives, or other means. Generally, the forward portion 24 of flat surface 19 is generally flat and suitable for the receipt of the removable sole 16. The rearward portion 26 of shoe upper 14 includes a special configuration suitable for receiving the locking means 18 of the present invention. It can be seen that the rearward portion 26 of the bottom surface 19 includes a longitudinal track 28 formed therein and extending down the center and on the bottom of shoe upper 14. As can be seen, longitudinal track 28 includes a first pair of receptacles 30 which are formed on the bottom surface 19 in a position generally adjacent to the position of the removable sole 16. It is also adjacent to the forward flat surface area 24. The shoe upper 14 also includes a second pair of receptacles 32 which are formed on opposite sides of the shoe upper 14. Although only one receptacle is illustrated in FIG. 2, the other receptacle will take on a similar appearance on an opposite side of shoe 14.

The second pair of receptacles 32 have a specialized configuration. First, it can be seen that a transverse track 34 extends from longitudinal track 28 as an indentation on the bottom surface 19 of shoe upper 14. The receptacles 32 is a slotted member which is suitable formed on an exterior of the side of shoe upper 14. In particular, the receptacles 32 have a first quartercircle 36 and a second quartercircle 38 formed thereon. The transverse slot 34 extends between the first quartercircle 36 and the second quartercircle 38. A suitable indentation is placed between the surface of shoe upper 14 and the outer edges of the quartercircles 36 and 38. The longitudinal track 28 extends toward the rear 40 of shoe upper 14. A specialized locking mechanism, illustrated in FIG. 3, is provided on the rear 40 of shoe upper 14, to be described hereinafter.

The shoe upper 14 has a generally conventional appearance. Suitable lacing, eyelets, and tongues can be provided so as to accommodate the needs of the user. The interior 17 of shoe upper 14 can include the necessary padding and support structure so as to properly accommodate the foot of a person. The rear 40 can include a heel patch and an Achille's tendon pad. The forward portion of the shoe upper 14 can be constructed with ornamentation, vamping, trim, and other features. The rearward bottom surface 26 can be made of rubber, hard plastic, or other material having a strength sufficient to support the user of the shoe 10 and to accommodate the locking mechanism of the present invention.

Referring to FIG. 2, the removable sole 16 is illustrated in detail. Specifically, the removable sole 16 is a foresole which is placed on the forward bottom surface 19 of shoe upper 14. The bottom surface of sole 16 is an outsole having a desired surface-engaging texture. In order to accommodate the various surfaces upon which the removable sole 16 can be used, the outsole 42 can employ studs, treads, patterns, or other features. The exact texture provided on outsole 42 is a matter of design choice and can be adjusted to the preference of the user.

The removable sole 16 is initially fastened to the toe area 22 of shoe upper 14. It can be seen that a toe receptacle 44 is provided on the forward portion of the sole 16. The toe receptacle 44 has a size generally matching the size of the toe area 22 of shoe upper 14. In order to attach the sole 16 to shoe upper 14, the toe area 22 slides into the opening 46 of the toe receptacle 44. The toe receptacle 44 may be made of a suitably rigid material which does not interfere with or impede performance, in any way. The toe receptacle 44 will receive much of the abuse given to a tennis shoe. So as to accommodate the needs of the user, the toe receptacle 44 can be made from a wide variety of materials (depending on what fashion or necessity would dictate). As such, the shoe can be fashionable, cost-effective, or both.

Importantly, the removable sole 16 fastens to shoe upper 14 in a secure manner by the use of strap 48. As can be seen, strap 48 is fastened to one side 50 of sole 42. The strap 48 can extend over the rearward portion 52 of toe area 22 of the shoe upper 14. As can be seen, the strap 48 is removably attached to side 54 of sole 16. In particular, it can be seen that a loop 56 is fastened to the side 54 of sole 16 so as to receive strap 48 therethrough. The strap 48 has a surface 58 of a hook-and-loop material, otherwise known as VELCRO (TM), and another surface 60 of hook-and-loop material. The strap 48 will extend around rearward portion 52 and will pass through loop 56. The strap 48 can be tightened by pulling on surface 60 so as to place the strap 48 in pressurized engagement upon of shoe upper 14. After a suitable tension is provided on the strap 48, the hook-and-loop material of surface 60 can be detachably fastened to the hook-and-loop material of surface 58. As such, the sole 16 can be properly secured to the bottom surface 19 of shoe upper 14. This strap 48 provides a great deal of lateral support to the shoe. Such lateral support is important when the shoe is used for playing tennis.

Importantly, the arrangement described hereinbefore provides suitable vertical stability to the removable sole on the shoe upper 14. It also is a proper arrangement for preventing a sole 16 from sliding rearwardly relative to the shoe 14. As such, as described, the sole 16 is a suitable interchangable sole for attachment to the shoe upper 14. However, for optimal performance, it is necessary to provide suitable tension so that the sole 16 does not slide forwardly from the shoe upper 14. As such, locking mechanism 18 is provided so as to properly secure the sole 16 to the shoe upper 14.

Initially, with reference to FIG. 2, it can be seen that the locking mechanism 18 includes a longitudinal strut 70 which has an end connected to end 72 of sole 16. The longitudinal strut 70 extends rearwardly from the sole 16 and enters the longitudinal track 28 on the bottom surface 19 of shoe upper 14. A first pair of tab elements 74 extends outwardly from the longitudinal strut 70. It can be seen that the configuration of the tab elements 74 correspond with the arrangement of the receptacles 30 on the shoe upper 14. As such, the tab elements 74 can engage the receptacles 30 by simply pressing the tab elements inwardly. The longitudinal strut 70 extends rearwardly from this first pair of tab elements 74. A transverse strut 76 extends from the longitudinal strut 70. A second pair of tab elements 78 are positioned on opposite ends of the transverse strut 76. It can be seen that the transverse strut 76 will enter into transverse slot 34 on the shoe upper 14. The circular tab element 78 will engage the receptacles 32 on each side of the shoe upper 14. A suitable engagement can be created by pulling on the edges of the circular tab element 78 until they extend above the slotted member 32. After the tab elements 78 are released, they will engage the indentations of the quartercircles 36 and 38. The longitudinal strut 70 extends further rearwardly from this second pair of tab elements 78. A third pair of circular tabs 80 are fastened to the far end of the longitudinal strut 70. As will be described hereinafter, the circular tabs 80 are received by a slotted mechanism on the rear 40 of shoe upper 14.

Referring to FIG. 3, there is shown the rearward view of shoe upper 14. In particular, it can be seen in FIG. 3 that the rear of shoe upper 14 includes an Achille's tendon pad 90, suitable foxing 92 and a heel support 94. The bottom surface 96 at end 40 of shoe upper 14 includes the longitudinal track 28 extending therethrough.

It is important to the embodiment of the present invention that the longitudinal track 28 extend upwardly from the shoe bottom surface 19 so as to form upward pathway 98. The foxing 92 of shoe upper 14 has a slotted member 100 attached thereto. The slotted member 100 is positioned on the end of the shoe upper 14 opposite to the toe area 22. A second slotted member 102 is formed adjacent to the first slotted member 100 on the end 40 of shoe upper 14. As such, the slotted members 100 and 102 work, in tandem, so as to provide the necessary restraining force for the retention of the removable sole 16 on the shoe upper 14.

Each of the slotted members 100 and 102 are comprised of a first quartercircle 104 and a second quartercircle 106. Each of the first quartercircle 104 and the second quartercircle 106 generally face each other. A slot 108 extends between each of the quartercircles 104 and 106. Each of the quartercircles 104 and 106 have an indentation formed adjacent to shoe surface 92. A divider member 110 is placed in pathway 98 so as to guide the longitudinal strut 70 in a proper position so that the circular tab elements (as shown in FIG. 2) are engaged within the slotted members 100 and 102. With reference to FIG. 2, it can be seen that the longitudinal strut 70 will extend through longitudinal track 28, will extend upwardly in pathway 78, and will divide so that the circular elements engage each of the receptacles 100 and 102. The engagement of the circular elements 80 with the slotted members 100 and 102 should have a sufficient tension so as to retain the removable sole 16 onto the shoe upper 14.

FIGS. 4A–C show the manner in which the tab elements can be placed within the slotted members. The illustrations of FIGS. 4A–C apply to the slotted members 100 and 102 on the rear 40 of shoe upper 14 and also apply to the configuration of the slotted members 32 positioned on each side of the shoe upper 14.

In FIG. 4A, it can be seen that the tab element 120 has a lower strut 120 which extends through the slot 124 between each of the quartercircles 126 and 128. In order to install the tab element 120 properly, it is necessary to exert a pulling force on the tab element 120 so as to draw the periphery 130 of tab element 120 beyond the upper edge 132 of the quartercircles 126 and 128. The tab element 122 should be placed in close juxtaposition to the relevant area of the shoe upper 14.

After the tab element 120 has been positioned as illustrated in FIG. 4A, the tab element 120 should be guided so that edge 130 generally enters the area of indentation between the quartercircles 126 and 128 and the surface of the shoe. It can be seen that the quartercircles 126 and 128 serve to guide the edge 130 of tab element 120 into a proper position. The strut 122 generally lowers into the slot 124. FIG. 4C shows the tab element 120 in its proper position for use. It can be seen that the periphery 130 is fully received by the quartercircles 126 and 128. The lower ends of the quartercircles 126 and 128 retain the periphery 130 in a final fixed position. The strut 122 extends downwardly through slot 124. After the tab element 120 has been secured in its proper location, then the removable sole is properly positioned and retained. The tab elements and the slotted members should be configured so as to exert tension on the longitudinal strut and to prevent the sole 16 from moving forward on the shoe upper 14. The technique for installing the tab element 120 within the slotted members is relatively simple and can be performed simply and easily.

For the purposes of illustration, FIG. 5 shows the preferred embodiment of the shoe 10 with the shoe upper 14 attached to the removable sole 16. It can be seen that each of the tab elements is placed within the receptacles formed on the exterior surface of the shoe upper 14. It can be seen that the toe receptacle 44 extends over the toe area 22 of the shoe upper 14. Additionally, it can be seen that the strap 48 is extended around the exterior surface 52 of shoe upper 14. Loop 56 allows the strap 48 to be appropriately tensioned so as to draw the sole 16 into proper engagement with the shoe upper 14. FIG. 5 also shows that the outsole 42 of removable sole 16 has a different texture than the outsole 42 as illustrated in FIG. 2.

The present invention offers significant advantages for athletes. The sole of the shoe can be adapted to a wide range of surface textures. As such, the only thing that is required for athletic performance will be the shoe upper and a multiplicity of removable soles. The athlete can experiment with the various soles in a quick and easy fashion so as to determine the sole which is most appropriate for use on a given surface. Since the sole can be installed on the shoe upper in a relatively quick fashion, no unnecessary time is wasted in the lacing and changing of shoes. The shoe upper will always remain on the foot of the person. The shoe upper will conform to the foot of the user over time. Thus, the shoe upper can be properly "broken in" by the user. The present invention eliminates the need to change the "broken-in" shoe upper whenever the sole becomes worn. This also serves to increase the life of the shoe.

The present invention eliminates the waste of having a large number of shoes. A single, relatively inexpensive, shoe upper can be utilized. The various soles can be carried in a stacked arrangement or otherwise stored without unnecessary use of space. It is not necessary to manufacture the entire shoe to accommodate various types of playing surfaces.

The removable sole fits securely to the bottom surface of the shoe upper. A large variety of forces can be applied to the sole without disrupting its position relative to the shoe upper. Tension is applied in all directions to the removable sole so as prevent any movement or dislodging of the surface.

The foregoing disclosure and description of the invention is illustrative and explanatory thereof. Various changes in the details of the illustrated configuration can be made within the scope of the appended claims without departing from the true spirit of the invention. The present invention should only be limited by the following claims and their legal equivalents.

I claim:

1. A shoe comprising:

a shoe upper having an interior for receiving a human foot, said shoe upper having a bottom surface formed thereon, said shoe upper having a toe area formed therein;

a slotted member formed on an exterior surface of said shoe upper, said slotted member formed on a back outer surface of said shoe upper opposite said toe area and above said bottom surface, said slotted member extending upwardly from an end of said bottom surface, said slotted member comprising a first quartercircle having an indentation formed adjacent said shoe upper and a second quartercircle facing said first quartercircle, said second quartercircle having another indentation formed adjacent said shoe upper, said first and second quartercircles having a slot extending therebetween;

a removable sole affixed across a forward portion of the bottom surface of said shoe upper, said removable sole having a toe receptacle for slidably fitting against and over said toe area of said shoe upper; and locking means formed on said removable sole for fastening said sole to the bottom surface of said shoe upper, said locking means connected to said removable sole so as to cause tension on said sole rearward of said toe receptacle, said locking means comprising:

a longitudinal strut extending toward said slotted member along the bottom surface of said shoe upper, said longitudinal strut having an end engaging said slotted member so as to tension said removable sole.

2. The shoe of claim 1, further comprising:

a second slotted member formed adjacent said first slotted member on said end of said shoe upper opposite said toe area.

3. The shoe of claim 1, said locking means further comprising:

said longitudinal strut having a circular tab formed at said end engaging said slotted member, said first and second quartercircles receiving said circular tab therein, said strut extending through said slot between said first and second quartercircles.

4. The shoe of claim 1, said removable sole having an outsole formed on a bottom side of said removable sole, said outsole having a desired surface-engaging texture.

5. The shoe of claim 1, said locking means comprising:

a strap fastened to one side of said removable sole and extending over said toe area of said shoe upper, said strap removably attached to another side of said sole, said strap for securing said removable sole to said shoe upper.

6. The shoe of claim 5, said another side of said sole having a loop fastened thereto, said loop receiving said strap therethrough.

7. The shoe of claim 6, said strap having one surface of hook-and-loop material and another surface of hook-and-loop material, said surfaces detachably fastened together, one of said surfaces extending through said loop.

8. A shoe comprising:

a shoe upper having an interior for receiving a human foot, said shoe upper having a bottom surface formed thereon, said shoe upper having a toe area formed therein;

a removable foresole affixed to a forward portion of the bottom surface of said shoe upper, said removable foresole having a toe receptacle for fitting adjacent at least a portion of said toe area of said shoe upper;

a strap fastened to one side of said removable foresole and extending over said toe area of said shoe upper, said strap interconnected to another side of said foresole so as to secure said foresole to the bottom surface of said shoe upper; and a slotted member formed on an exterior surface of said shoe upper, said slotted member formed on an end of said shoe upper opposite said toe area, said slotted member receiving a locking member, said slotted member comprising a first quartercircle having an indentation formed adjacent said shoe upper and a second quartercircle facing said first quartercircle, said second quartercircle having another indentation formed adjacent said shoe upper, said first and second quartercircles having a slot extending therebetween.

9. The shoe of claim 8, said another side of said foresole having a loop fastened thereto, said loop receiving said strap therethrough, said strap having one surface of hook-and-loop material and another surface of hook-and-loop material, said surfaces detachably fastened together, one of said surfaces extending through said loop.

10. The shoe of claim 8, said shoe upper having a longitudinal track formed in said bottom surface, said shoe further comprising:

a longitudinal strut connected to said removable foresole and extending rearwardly therefrom, said longitudinal strut received by said longitudinal track in said bottom surface of said shoe upper.

11. The shoe of claim 10, said shoe upper having a plurality of receptacles formed in said bottom surface and branching outwardly from said longitudinal track, said longitudinal strut having a plurality of tab elements branching outwardly from said longitudinal strut, said receptacles receiving said tab elements.

12. The shoe of claim 8, said removable foresole having an outsole formed on a bottom side of said removable foresole, said outsole having a desired surface-engaging texture.

* * * * *